US010772173B1

(12) United States Patent
Bewick et al.

(10) Patent No.: US 10,772,173 B1
(45) Date of Patent: Sep. 8, 2020

(54) SYSTEMS, METHODS, AND DEVICES FOR CONTROLLING ONE OR MORE LED LIGHT FIXTURES

(71) Applicant: Electronic Theatre Controls, Inc., Middleton, WI (US)

(72) Inventors: Gary Bewick, Cross Plains, WI (US); William R. Florac, Verona, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 16/546,501

(22) Filed: Aug. 21, 2019

(51) Int. Cl.
*H05B 45/20* (2020.01)

(52) U.S. Cl.
CPC ..... *H05B 45/20* (2020.01)

(58) Field of Classification Search
CPC .. H05B 37/02; H05B 37/0209; H05B 37/029; H05B 33/02; H05B 33/08; H05B 33/0803; H05B 33/0806; H05B 33/0857; H05B 33/086; H05B 33/0863; H05B 45/20; H05B 45/22; H05B 45/24; H05B 45/30; H05B 47/10; H05B 47/105; H05B 47/11; H05B 47/155
See application file for complete search history.

(56) References Cited

U.S. PATENT DOCUMENTS 6,577,080 B2 6/2003 Lys et al.
7,482,565 B2 1/2009 Morgan et al.
7,520,634 B2 4/2009 Ducharme et al.
7,845,823 B2 12/2010 Mueller et al.
7,868,562 B2 1/2011 Salsbury et al.
8,384,294 B2 2/2013 Hatley et al.
8,403,523 B2 3/2013 Gerlach et al.
8,593,074 B2 11/2013 Hatley et al.
8,665,296 B2 3/2014 Zulch
8,708,560 B2 4/2014 Kraemer
8,723,450 B2 5/2014 Hatley et al.
8,866,410 B2 10/2014 Negley et al.
9,144,140 B1 * 9/2015 Bewick ..... H05B 45/22
9,335,210 B2 5/2016 Li et al.
9,451,668 B2 * 9/2016 Bewick ..... H05B 45/14
9,480,130 B2 10/2016 Van De Sluis et al.
9,554,445 B2 1/2017 Chobot
(Continued)

FOREIGN PATENT DOCUMENTS

WO 01/24584 A1 4/2001

*Primary Examiner* — Jason Crawford
(74) *Attorney, Agent, or Firm* — Michael Best and Friedrich LLP

(57) ABSTRACT

A light fixture including an array of LED light sources corresponding to a color channel of the light fixture, a driver circuit configured to drive the array of LED light sources, and a controller. The controller controls the operation of the light fixture to receive a direct drive signal related to a direct drive signal value for the array of LED light sources, determine an output of a reference light fixture based on the direct drive signal, determine a value for a color channel drive signal based on the output of the reference light fixture, and provide a control signal to the driver circuit to cause the driver circuit to apply the color channel drive signal having the value to the array of LED light sources. The value for the color channel drive signal results in an output of the light fixture that matches the output of the reference light fixture.

20 Claims, 6 Drawing Sheets

(56) References Cited

U.S. PATENT DOCUMENTS

| | | | | |
|---|---|---|---|---|
| 9,713,222 | B2 * | 7/2017 | Bewick | H05B 45/22 |
| 10,149,364 | B2 | 12/2018 | Dupras et al. | |
| 2006/0018118 | A1 | 1/2006 | Lee et al. | |
| 2006/0132800 | A1 * | 6/2006 | Yoshida | G01J 1/42 356/601 |
| 2006/0158881 | A1 * | 7/2006 | Dowling | G03G 15/0435 362/231 |
| 2008/0225021 | A1 | 9/2008 | Hekstra et al. | |
| 2011/0137757 | A1 * | 6/2011 | Paolini | G06Q 30/0601 705/27.1 |
| 2012/0153839 | A1 | 6/2012 | Farley et al. | |
| 2012/0229048 | A1 * | 9/2012 | Archer | H05B 47/175 315/297 |
| 2013/0214704 | A1 | 8/2013 | Gerlach et al. | |
| 2013/0307419 | A1 * | 11/2013 | Simonian | H05B 45/20 315/153 |
| 2015/0369658 | A1 * | 12/2015 | Selverian | G01J 1/42 356/218 |
| 2017/0265258 | A1 | 9/2017 | Hurley et al. | |

* cited by examiner

SYSTEMS, METHODS, AND DEVICES FOR CONTROLLING ONE OR MORE LED LIGHT FIXTURES

FIELD

Embodiments described herein relate to controlling one or more light fixtures.

SUMMARY

Conventional light fixtures that include light-emitting diode ("LED") light sources can be operated in a direct drive mode. In the direct drive mode, each discrete LED color channel receives a drive signal corresponding to a particular drive value for that color channel. The direct drive mode of operation for an LED light fixture is particularly beneficial when a user desires the ability to directly manipulate an output spectrum of the LED light fixture. For example, a user can manipulate input devices on a control panel that correspond to the drive values for the color channels of the LED light fixture. If the user desires more green in the output of the light fixture, the user manually increases the drive value corresponding to the green color channel of the LED light fixture. Such a direct drive mode provides more user control over the output of the LED light fixture than, for example, a calibrated mode of operation for the LED light fixture. Calibrated modes of operation for an LED light fixture include, for example, hue-saturation-intensity ("HSI") control, hue-saturation-intensity-color temperature ("HSIC") control, and red-green-blue ("RGB") control.

However, the direct drive mode of operation for an LED light fixture becomes very complicated when a plurality (i.e., two or more) LED light fixtures are driven simultaneously (e.g., in parallel). If two LED light fixtures are driven in parallel using the same color channel input drive values, the output spectrums generated by the plurality of light fixtures may not match. Variations in the output spectrums among the light fixtures can result, for example, from manufacturing variability of the individual LED light sources in each fixture. These variations in the outputs of the light fixtures can significantly affect the appearance of the light produced by the different light fixtures. An ability to provide direct drive signals to a plurality of light fixtures, while producing a consistent light output among the plurality of light fixtures, would provide a significant benefit and improvement over conventional lighting systems.

Embodiments described herein provide systems, methods, and devices for controlling one or more LED light fixtures based on direct drive signals to produce a consistent light output among the LED light fixtures. The consistent light output among the LED light fixtures is produced despite manufacturing variations among the LED light fixtures that would otherwise result in inconsistent light outputs among the LED light fixtures when driven by the same direct color channel drive signals.

A controller provides the same direct drive signals to each LED light fixture. The direct drive signals can be based on one or more inputs received from a user or based on values stored in a memory (e.g., a memory of the controller). The direct drive signals are received by each LED light fixture. However, the LED light fixtures do not use the direct drive signals to immediately set the drive signals for their respective output color channels. Rather, each LED light fixture uses the received direct drive signals as an input to a reference or ideal light fixture. Information or data related to the reference light fixture is stored in a memory (e.g., a memory of the controller) and is used to determine or reconstruct the output (e.g., color point and/or spectrum) that the reference light fixture would produce based on the received direct drive signals. Each light fixture then determines drive values for its own color channels that produce a matching output to the reference light fixture's output based on the actual light sources in the respective LED light fixture. Each light fixture can then drive its output color channels at the drive values determined based on the reference light fixture's output. As a result, each light fixture is likely to have different drive values for corresponding color channels. However, each of the plurality of light fixtures will accurately reproduce the reference light fixture's output.

Matching the light fixture's output to the reference light fixture's output (e.g., color point and/or spectrum) by each of the plurality of LED light fixtures can be resource intensive and may require, for example, processing and memory capabilities not conventionally included in a light fixture. The processing and memory demand associated with matching the light fixture's output to the reference light fixture's output can result in increased or excessive latency with respect to control modifications if insufficient processing and memory resources are present. However, a more efficient technique for matching the reference light fixture's output can be implemented that requires less processing and memory resources in the light fixture. For example, to reduce processing and memory requirements for the light fixture, the light fixture's color channels can be normalized to match color channel drive values for the reference light fixture. The color channels are then controlled to maximize brightness and match the reference light fixture output (e.g., color point and/or spectrum) within a reduced variation window (e.g., approximately +/−5%) centered around the normalized color channel values. By restricting the color channel modifications that are made by the light fixture to match the output of the reference light fixture, the light fixture is capable of operating with fewer computational and memory resources.

Embodiments described herein provide a light fixture including an array of LED light sources corresponding to a color channel of the light fixture, a driver circuit configured to drive the array of LED light sources, and a controller. The controller includes a non-transitory computer readable medium and a processing unit. The controller includes computer executable instructions stored in the computer readable medium for controlling operation of the light fixture to receive a direct drive signal related to a direct drive signal value for the array of LED light sources, determine an output of a reference light fixture based on the direct drive signal, determine a value for a color channel drive signal based on the output of the reference light fixture, and provide a control signal to the driver circuit to cause the driver circuit to apply the color channel drive signal having the value to the array of LED light sources. The value for the color channel drive signal corresponds to a drive value for the color channel that results in an output of the light fixture that matches the output of the reference light fixture.

Embodiments described herein provide a system for controlling an output of each of a plurality of light fixtures. The system includes a controller and a light fixture. The controller is configured to generate a direct drive signal related to a direct drive signal value for one or more arrays of LED light sources. The light fixture includes an array of LED light sources corresponding to a color channel of the light fixture, a driver circuit configured to drive the array of LED light sources, and a light fixture controller. The light fixture controller includes a non-transitory computer readable medium and a processing unit. The light fixture controller includes computer executable instructions stored in the computer readable medium for controlling operation of the light fixture to receive the direct drive signal related to the direct drive signal value for the one or more arrays of LED light sources, determine an output of a reference light fixture based on the direct drive signal, determine a value for a color channel drive signal based on the output of the reference light fixture, and provide a control signal to the driver circuit to cause the driver circuit to apply the color channel drive signal having the value to the array of LED light sources. The value for the color channel drive signal corresponds to a drive value for the color channel that results in an output of the light fixture that matches the output of the reference light fixture.

Embodiments described herein provide a method of controlling a light fixture. The method includes receiving a direct drive signal related to a direct drive signal value for an array of LED light sources, determining an output of a reference light fixture based on the direct drive signal, determining a value for a color channel drive signal based on the output of the reference light fixture, and providing the color channel drive signal having the value to the array of LED light sources. The value for the color channel drive signal corresponds to a drive value for a color channel that results in an output of the light fixture that matches the output of the reference light fixture.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers" and "computing devices" described in the specification can include one or more processing units, one or more computer-readable medium modules, one or more input/output interfaces, and various connections (e.g., a system bus) connecting the components.

Other aspects of the embodiments will become apparent by consideration of the detailed description and accompanying drawings.

MATHEMATICAL TERMINOLOGY

M is a matrix M.

$\vec{V}$ is a vector V, which can be interpreted as a row vector or a column vector.

$\vec{V}*\vec{W}$ is an element-by-element product of the vector V and a vector W.

$$\frac{\vec{V}}{\vec{W}}$$

is an element-by-element division of the vector V and the vector W.

$M \otimes Q$ is a matrix multiplication of the matrix M and a matrix Q, which is different from $Q \otimes M$.

$\|\vec{V}\|_\infty$ is the maximum value of any of the elements of the vector V.

n is a number of color channels in a light fixture.

p is a number of points in an uncompressed spectrum.

k is a number of points in a compressed spectrum.

$M\|\vec{V}$ appends the column vector V to the right hand side of the matrix M.

XYONE is a color mixer compilation constant (e.g., 1023) that sets the precision of an input color.

DETAILED DESCRIPTION

Embodiments described herein provide systems, methods, and devices for controlling one or more light-emitting diode ("LED") light fixtures based on a direct drive signal provided to the one or more LED light fixtures. The direct drive signal is received by an LED light fixture and the LED light fixture uses the received direct drive signal as an input to a reference or ideal light fixture. The LED light fixture determines an output that the reference light fixture would produce based on the received direct drive signal. The LED light fixture then determines one or more values for drive signals that are used to drive one or more color channels of the LED light fixture. The values for the drive signals are determined such that the LED light fixture produces the same output as the reference light fixture based on the direct drive signal. The output can include a color point that matches (e.g., approximately or exactly matches) the color point of the output of the reference light fixture. The output can also include a spectrum that matches (e.g., approximately or exactly matches) the spectrum of the output of the reference light fixture. Each light fixture can include data related to the same reference light fixture. As a result, each light fixture is able to match the output of the reference light fixture based on the same received direct drive signal.

Figure 1:
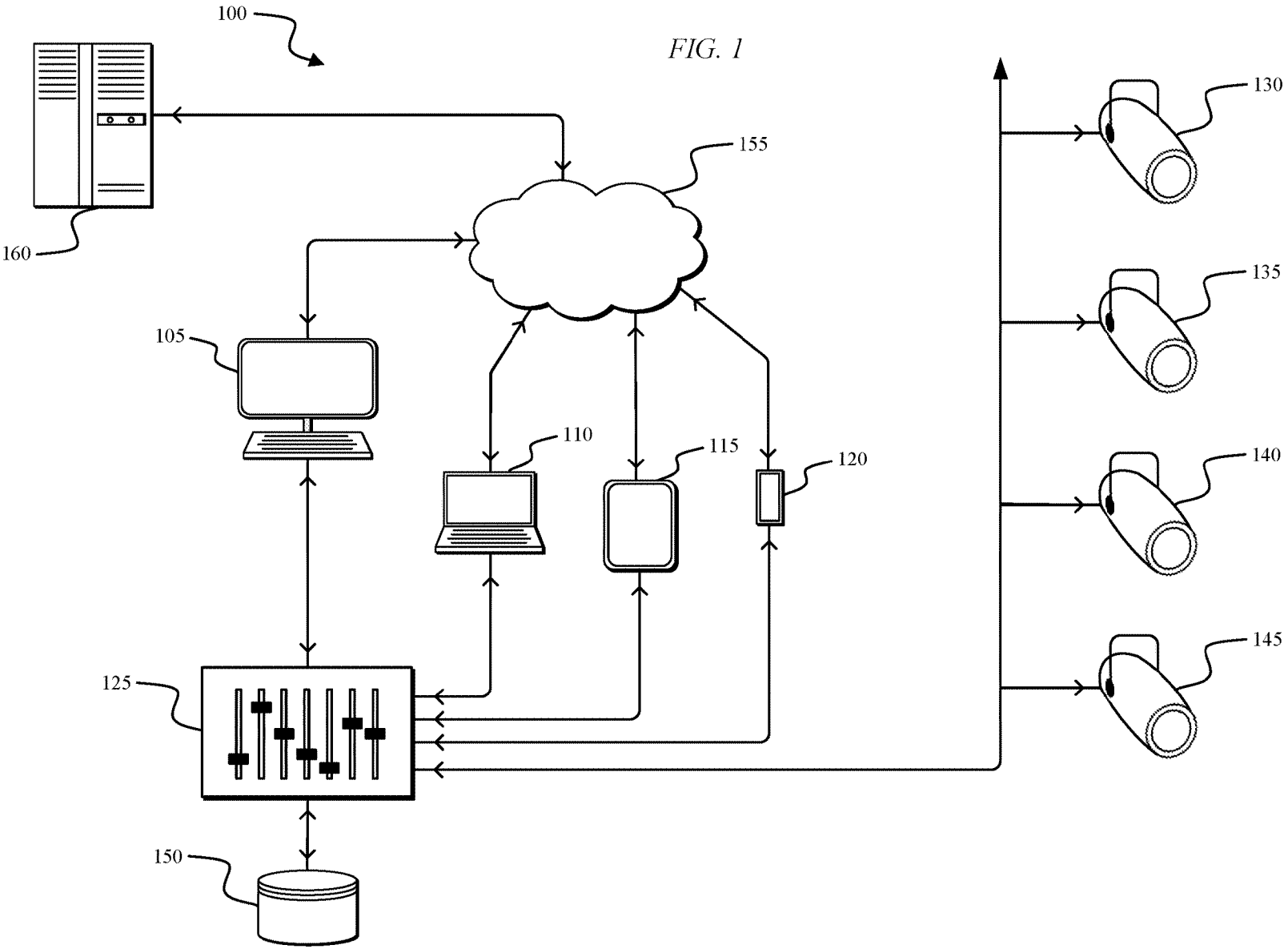
FIG. 1 illustrates a lighting system for controlling one or more LED light fixtures, according to embodiments described herein.

FIG. 1 illustrates a lighting system 100 for controlling a plurality of LED light fixtures. The system 100 includes a plurality of user input devices 105-120, a control board or control panel 125, a first light fixture 130, a second light fixture 135, a third light fixture 140, a fourth light fixture 145, a database 150, a network 155, and a server-side mainframe computer or server 160. The plurality of user input devices 105-120 include, for example, a personal or desktop computer 105, a laptop computer 110, a tablet computer 115, and a mobile phone (e.g., a smart phone) 120.

Each of the devices 105-120 is configured to communicatively connect to the server 160 through the network 155 and provide information to, or receive information from, the server 160 related to the control or operation of the system 100. Each of the devices 105-120 is also configured to communicatively connect to the control board 125 to provide information to, or receive information from, the control board 125. The connections between the user input devices 105-120 and the control board 125 or network 155 are, for example, wired connections, wireless connections, or a combination of wireless and wired connections. Similarly, the connections between the server 160 and the network 155 or the control board 125 and the light fixtures 130-145 are wired connections, wireless connections, or a combination of wireless and wired connections.

The network 155 is, for example, a wide area network ("WAN") (e.g., a TCP/IP based network), a local area network ("LAN"), a neighborhood area network ("NAN"), a home area network ("HAN"), or personal area network ("PAN") employing any of a variety of communications protocols, such as Wi-Fi, Bluetooth, ZigBee, etc. In some implementations, the network 155 is a cellular network, such as, for example, a Global System for Mobile Communications ("GSM") network, a General Packet Radio Service ("GPRS") network, a Code Division Multiple Access ("CDMA") network, an Evolution-Data Optimized ("EV-DO") network, an Enhanced Data Rates for GSM Evolution ("EDGE") network, a 3GSM network, a 4GSM network, a 4G LTE network, a 5G New Radio, a Digital Enhanced Cordless Telecommunications ("DECT") network, a Digital AMPS ("IS-136/TDMA") network, or an Integrated Digital Enhanced Network ("iDEN") network, etc.

Figure 2:
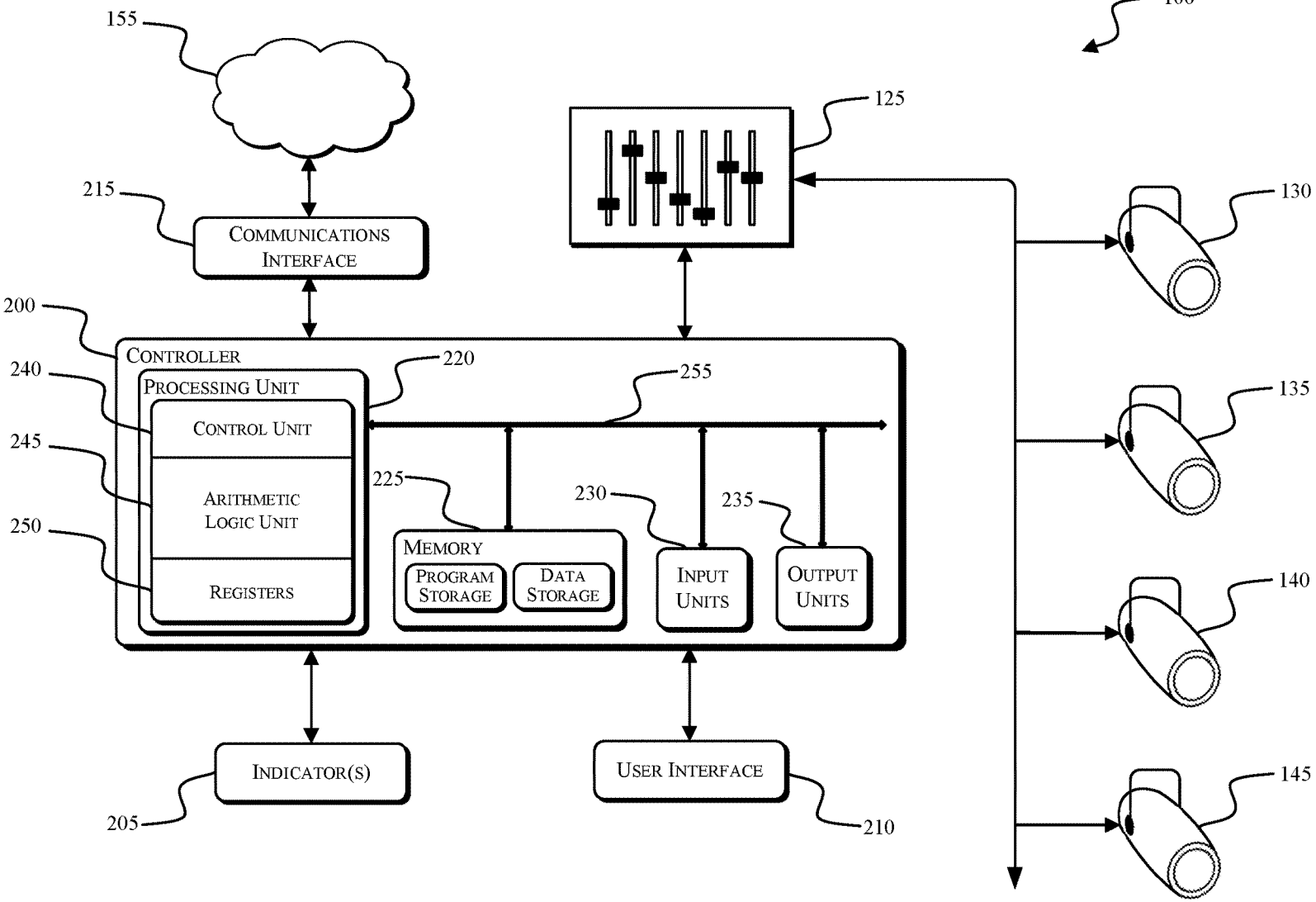
FIG. 2 illustrates a controller for the lighting system of FIG. 1, according to embodiments described herein.

FIG. 2 illustrates a controller 200 for the system 100. The controller 200 is electrically and/or communicatively connected to a variety of modules or components of the system 100. For example, the illustrated controller 200 is connected to one or more indicators 205 (e.g., LEDs, a liquid crystal display ["LCD" ], etc.), a user input or user interface 210 (e.g., a user interface of the user input device 105-120 in FIG. 1), and a communications interface 215. The controller 200 is also connected to the control board 125. The communications interface 215 is connected to the network 155 to enable the controller 200 to communicate with the server 160. The controller 200 includes combinations of hardware and software that are operable to, among other things, control the operation of the system 100, control the operation of the light fixtures 130-145, communicate over the network 155, communicate with the control board 125, receive input from a user via the user interface 210, provide information to a user via the indicators 205, etc.

In the embodiment illustrated in FIG. 2, the controller 200 would be associated with one of the user input devices 105-120. As a result, the controller 200 is illustrated in FIG. 2 is being connected to the control board 125 which is, in turn, connected to the first light fixture 130, the second light fixture 135, the third light fixture 140, and the fourth light fixture 145. In other embodiments, the controller 200 is included within the control board 125, and, for example, the controller 200 can provide control signals directly to the first light fixture 130, the second light fixture 135, the third light fixture 140, and the fourth light fixture 145. In other embodiments, the controller 200 is associated with the server 160 and communicates through the network 155 to provide control signals to the control board 125 and the first light fixture 130, the second light fixture 135, the third light fixture 140, and the fourth light fixture 145.

The controller 200 includes a plurality of electrical and electronic components that provide power, operational control, and protection to the components and modules within the controller 200 and/or the system 100. For example, the controller 200 includes, among other things, a processing unit 220 (e.g., a microprocessor, a microcontroller, or another suitable programmable device), a memory 225, input units 230, and output units 235. The processing unit 220 includes, among other things, a control unit 240, an arithmetic logic unit ("ALU") 245, and a plurality of registers 250 (shown as a group of registers in FIG. 2), and is implemented using a known computer architecture (e.g., a modified Harvard architecture, a von Neumann architecture, etc.). The processing unit 220, the memory 225, the input units 230, and the output units 235, as well as the various modules or circuits connected to the controller 200 are connected by one or more control and/or data buses (e.g., common bus 255). The control and/or data buses are shown generally in FIG. 2 for illustrative purposes. The use of one or more control and/or data buses for the interconnection between and communication among the various modules, circuits, and components would be known to a person skilled in the art in view of the invention described herein.

The memory 225 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 220 is connected to the memory 225 and executes software instructions that are capable of being stored in a RAM of the memory 225 (e.g., during execution), a ROM of the memory 225 (e.g., on a generally permanent basis), or another non-transitory computer readable medium such as another memory or a disc. Software included in the implementation of the system 100 and controller 200 can be stored in the memory 225 of the controller 200. The software includes, for example, firmware, one or more applications, program data, filters, rules, one or more program modules, and other executable instructions. The controller 200 is configured to retrieve from the memory 225 and execute, among other things, instructions related to the control processes and methods described herein. In other embodiments, the controller 200 includes additional, fewer, or different components.

The user interface 210 is included to provide user control of the system 100 and/or light fixtures 130-145. The user interface 210 is operably coupled to the controller 200 to control, for example, drive signals provided to the light fixtures 130-145. The user interface 210 can include any combination of digital and analog input devices required to achieve a desired level of control for the system 100. For example, the user interface 210 can include a computer having a display and input devices, a touch-screen display, a plurality of knobs, dials, switches, buttons, faders, or the like. In the embodiment illustrated in FIG. 2, the user interface 210 is separate from the control board 125. In other embodiments, the user interface 210 is included in the control board 125.

The controller 200 is configured to work in combination with the control board 125 to provide direct drive signals to the light fixtures 130-145. As described above, in some embodiments, the controller 200 is configured to provide direct drive signals to the light fixtures 130-145 without separately interacting with the control board 125 (e.g., the control board 125 includes the controller 200). The direct drive signals that are provided to the light fixtures 130-145 are provided, for example, based on a user input received by the controller 200 from the user interface 210.

Figure 3:
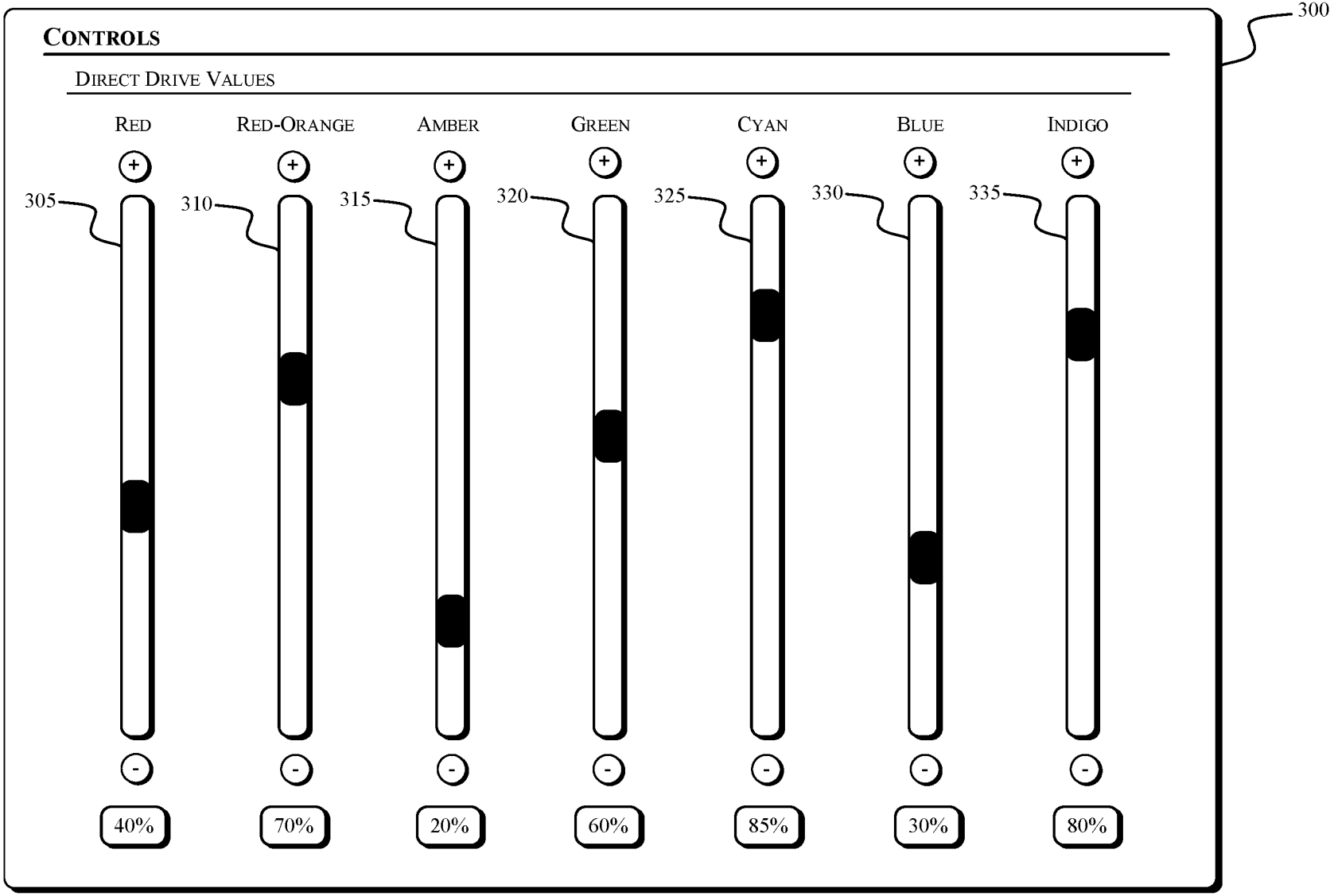
FIG. 3 illustrates a control interface for the lighting system of FIG. 1, according to embodiments described herein.

FIG. 3 illustrates a general interface 300 that can be included in the user interface 210 for controlling the direct drive signals provided to the light fixtures 130-145. The interface 300 includes individual controls for each color channel of the light fixtures 130-145. For example, the interface 300 includes a red control device 305, a red-orange control device 310, an amber control device 315, a green control device 320, a cyan control device 325, a blue control device 330, and an indigo control device 335. In other embodiments, additional or different controls are included. The seven control devices 305-335 shown in the interface 300 of FIG. 3 are shown for illustrative purposes. Each of the control units includes, for example, a slider or fader for manually adjusting a direct drive value for each color channel.

The control devices 305-335 set using the interface 300 provide input signals to the controller 200 which, in turn, generates, or instructs the control panel 125 to generate, direct drive signals to be provided to the light fixtures 130-145. In some embodiments, rather than receiving values for direct drive signals through the interface 300, values for the direct drive signals for the light fixtures 130-145 can be retrieved from the memory 225 (e.g., as part of a controlled lighting program). In other embodiments, values for the direct drive signals for the light fixtures 130-145 are received by the controller 200 over the network 155 from the server 160.

Figure 4:
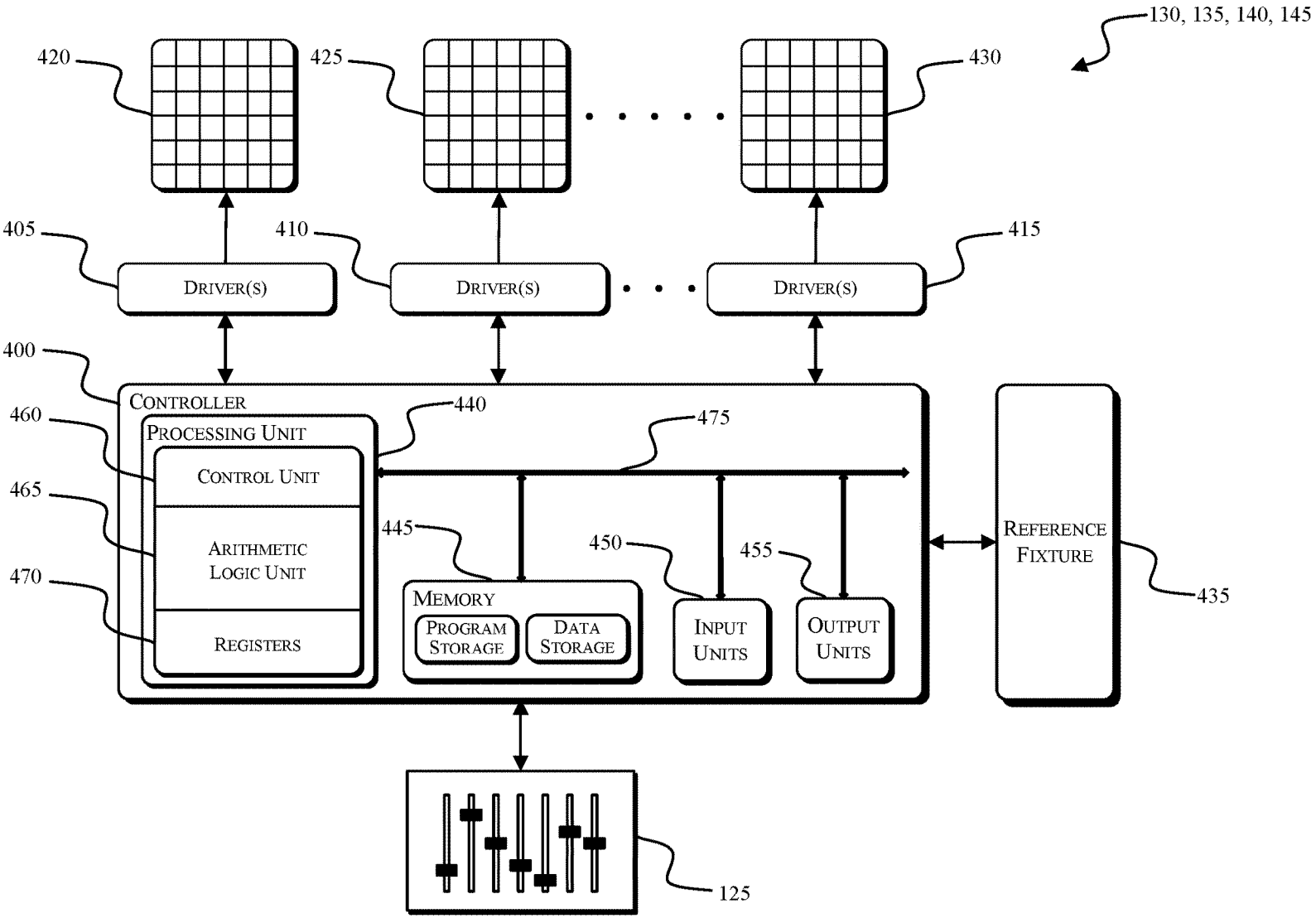
FIG. 4 illustrates a controller for a light fixture within the lighting system of FIG. 1, according to embodiments described herein.

FIG. 4 illustrates a controller 400 for the light fixtures 130-145. In some embodiments, the controller 400 represents a controller that is included within each of the light fixtures 130-145. The controller 400 is electrically and/or communicatively connected to a variety of modules or components of the light fixture 130-145. For example, the illustrated controller 400 is connected to the control board 125, a first light source driver or driver circuit 405, a second light source driver or driver circuit 410, and a third light source driver or driver circuit 415. The controller 400 includes combinations of hardware and software that are operable to, among other things, receive direct drive signals from the control board 125, control the operation of the light fixture 130-145, and generate and provide control signals for the first light source driver 405, the second light source driver 410, and the third light source driver 415.

The first light source driver 405 is connected to a first array of light sources 420 for providing one or more drive signals to the first array of light sources 420. The second light source driver 410 is connected to a second array of light sources 425 for providing one or more drive signals to the second array of light sources 425. The third light source driver 415 is connected to a third array of light sources 430 for providing one or more drive signals to the third array of light sources 420. Although FIG. 4 illustrates three light source drivers and three arrays of light sources, other embodiments include additional light source drivers and arrays of light sources. For example, each array of light sources can correspond to a particular color channel (e.g., green, blue, etc.) for the light fixture 130-145, and each color channel includes a separate light source driver. The controller 400 is also connected to a reference or virtual fixture 435. The reference light fixture 435 is shown in FIG. 4 as being separate from and connected to the controller 400 for illustrative purposes. In some embodiments, the reference light fixture 435 is incorporated into the controller 400 (e.g., a memory of the controller 400). The controller 400 includes combinations of hardware and software that are operable to communicate or otherwise interact with the reference light fixture 435.

The controller 400 includes a plurality of electrical and electronic components that provide power, operational control, and protection to the components and modules within the controller 400 and/or the light fixture 130-145. For example, the controller 400 includes, among other things, a processing unit 440 (e.g., a microprocessor, a microcontroller, or another suitable programmable device), a memory 445, input units 450, and output units 455. The processing unit 440 includes, among other things, a control unit 460, an ALU 465, and a plurality of registers 470 (shown as a group of registers in FIG. 4), and is implemented using a known computer architecture (e.g., a modified Harvard architecture, a von Neumann architecture, etc.). The processing unit 440, the memory 445, the input units 450, and the output units 455, as well as the various modules or circuits connected to the controller 400 are connected by one or more control and/or data buses (e.g., common bus 475). The control and/or data buses are shown generally in FIG. 4 for illustrative purposes. The use of one or more control and/or data buses for the interconnection between and communication among the various modules, circuits, and components would be known to a person skilled in the art in view of the invention described herein.

The memory 445 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 440 is connected to the memory 445 and executes software instructions that are capable of being stored in a RAM of the memory 445 (e.g., during execution), a ROM of the memory 445 (e.g., on a generally permanent basis), or another non-transitory computer readable medium such as another memory or a disc. Software included in the implementation of the light fixture 130-145 and controller 400 can be stored in the memory 445 of the controller 400. The software includes, for example, firmware, one or more applications, program data, filters, rules, one or more program modules, and other executable instructions. In some embodiments, the reference light fixture 435 is stored within the memory 445 of the controller 400. The controller 400 is configured to retrieve from the memory 445 and execute, among other things, instructions related to the control processes and methods described herein. In other embodiments, the controller 400 includes additional, fewer, or different components.

The reference light fixture 435 corresponds to software code or a circuit that represents a generalization or idealization of a particular type of light fixture. For example, light fixtures of a particular type operate in a similar manner to one another. However, each light fixture of the same type does not operate exactly the same as other light fixtures of the same type. As a result, each of the light fixtures 130-145 includes calibration information or data related to the actual LED light sources in the light fixture 130-145. The reference light fixture 435 represents how the generalized version of the particular light fixture type will respond to particular direct drive signals, and can be used to determine an output (e.g., color point and/or spectrum) that the generalized version of the particular light fixture would produce. The calibration information specific to the light fixture 130-145 is then used to match the output of the light fixture 130-145 to the output the reference light fixture 435 would produce.

Figure 5:
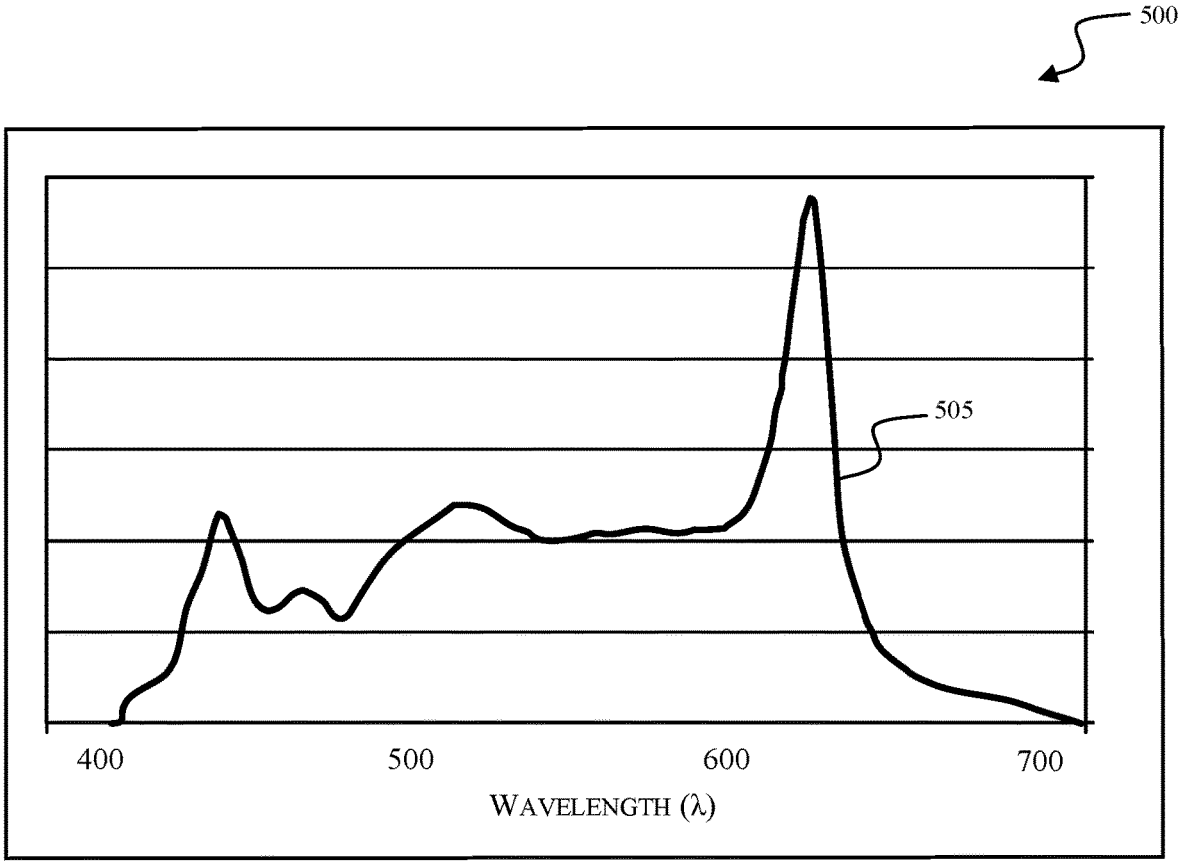
FIG. 5 illustrates a composite spectral output for a reference light fixture, according to embodiments described herein.

For example, when the light fixture 130-145 (e.g., controller 400) receives direct drive signals from the control board 125, the drive values corresponding to the direct drive signals are input by the controller 400 to the reference light fixture 435 (e.g., separate from the controller 400 or stored in the memory 445 of the controller 400). The reference light fixture 435 is configured or programmed to produce an output spectrum based on stored spectral data or information for the reference light fixture 435. FIG. 5 illustrates a graph 500 of an exemplary composite spectral output 505 for the reference light fixture 435. Each of the light sources that would be included in the reference light fixture 435 (e.g., green, blue, etc.) produces an output spectrum that falls within the composite spectral output 505 for the reference light fixture 435. The composite spectral output 505 is shown in FIG. 5 for illustrative purposes. The composite spectral output 505 will vary based on the light sources or color channels that are included in the reference light fixture 435, and each individual color channel included in the reference light fixture 435 has a separate spectral output (e.g., calibration information) that can be plotted in the graph 500. The individual spectral outputs of the individual color channels are used in conjunction with the received direct drive signals to generate the respective output of the individual color channels. The respective outputs of the individual color channels are then combined (e.g., by the controller 400) to produce a composite output color and composite output spectrum for the reference light fixture 435 based on the received direct drive signals.

The controller 400 is configured to store the composite output color and composite output spectrum for the reference light fixture 435 in, for example, the memory 445. The light fixture 130-145 uses this reference light fixture data in conjunction with the stored calibration data for the individual light fixture 130-145 (e.g., the spectral information for the actual light sources in each color channel) and matches the output of the light fixture 130-145 to the output of the reference light fixture 435 (e.g., using an iterative color creation and matching algorithm operating in the CIE xy Y color space). In some embodiments, the controller 400 is configured to exactly match the composite output color of the reference light fixture 435 and exactly match the composite output spectrum of the reference light fixture 435. In other embodiments, the controller 400 is configured to exactly match the composite output color of the reference light fixture 435 and approximately match the composite output spectrum of the reference light fixture 435 (e.g., produce a best spectral match to the composite output spectrum). In other embodiments, the controller 400 is configured to approximately match the composite output color of the reference light fixture 435 (e.g., produce a best color match to the composite output color) and approximately match the composite output spectrum of the reference light fixture 435 (e.g., produce a best spectral match to the composite output spectrum). In some embodiments, the controller 400 and reference light fixture 435 are configured to emulate a low or lower complexity LED light fixture (e.g., a three or four color channel LED light fixture) using a high or higher complexity LED light fixture (e.g., a seven to twelve color channel LED light fixture).

To produce the composite output color and the composite output spectrum of the reference light fixture 435, the controller 400 provides a plurality of direct or input drive signals to the reference light fixture 435. The input drive signals to the reference light fixture 435 can be labeled from 0 to n−1, where n is the number of color channels of the reference light fixture 435. The wavelengths of light representing any spectra of light can be labeled p. For illustrative purposes, the number of color channels of the reference light fixture 435 is considered to be the same as the number of color channels in the light fixture 130-145. In some embodiments, the number of color channels in the reference light fixture 435 is different (e.g., greater than or less than) the number of color channels in the light fixtures 130-145. The inputs used by the reference light fixture 435 can be represented as follows in EQNS. 1-3:

$$R=[\vec{R}_0,\vec{R}_1,\ldots,\vec{R}_{n-1}] \quad \text{EQN. 1}$$

$$T=[T_0,T_1,\ldots,T_{n-1}] \quad \text{EQN. 2}$$

$$O=\begin{bmatrix}\bar{x}(\lambda)\\ \bar{y}(\lambda)\\ \bar{z}(\lambda)\\ V(\lambda)\end{bmatrix} \quad \text{EQN. 3}$$

where R is a p×n matrix having columns that include the full spectra for each of the color channels of the reference light fixture 435. T is a p×n matrix having columns that include the full spectra for each of the color channels of the light fixture 130-145. O is a 4×p matrix. The first three rows of O are standard observer color matching functions for the color space that is being used (e.g., 2° or 10° observers). The fourth row of O is a luminosity function. In some embodiments, a standard luminosity function such as the CIE 1924 photopic luminosity function V(λ) or the standard scotopic luminosity function V'(λ) is used. In other embodiments, the CIE 1931 color matching luminosity function $\bar{y}(\lambda)$ is used. The controller 400 is also configured to use one or more precomputed input values, as provided below in EQNS. 4 and 5:

$$XYZV^r = O\otimes R=\begin{bmatrix}X_0^r, X_1^r, \ldots X_{n-1}^r\\ Y_0^r, Y_1^r, \ldots Y_{n-1}^r\\ Z_0^r, Z_1^r, \ldots, Z_{n-1}^r\\ V_0^r, V_1^r, \ldots V_{n-1}^r\end{bmatrix} \quad \text{EQN. 4}$$

$$=\begin{bmatrix}\vec{X}^r\\ \vec{Y}^r\\ \vec{Z}^r\\ \vec{V}^r\end{bmatrix}$$

-continued $$XYZV^t = O \otimes T \quad \text{EQN. 5}$$

where $XYZV^r$ is a 4×n matrix having columns that include the X, Y, Z, and V components for each of the individual color channels in the reference light fixture 435, and $XYZV^t$ is a 4×n matrix having columns that include the X, Y, Z, V components for each of the individual color channels in the light fixture 130-145.

There are often a large number of rows in the matrices R and T. For example, spectrums are often at 1 nanometer ("nm") or smaller intervals and require vectors of at least 401 points to cover the visible spectrum of light from approximately 380 nm to approximately 780 nm. In some embodiments, such a high resolution is not necessary, for example, because the light fixtures 130-145 have a comparatively small number of color channels (e.g., twelve or fewer color channels). The controller 400 is configured to reduce the computational requirements associated with the reference light fixture 435 by compressing spectrums into bands and summing groups of adjacent values into a single value that represents the area of the spectral band. The spectral bands are not required to be uniform in width (i.e., nm width). For example, using matrix R, the entire wavelength range from 380 nm to 780 nm can be combined into two bands using the 2×p compression matrix, C, provided in EQNS. 6 and 7 below:

$$C = \begin{bmatrix} 1, 1, \ldots, 1, 1, 0, 0, \ldots, 0, 0 \\ 0, 0, \ldots, 0, 0, 1, 1, \ldots, 1, 1 \end{bmatrix} \quad \text{EQN. 6}$$

$$C \otimes R \rightarrow a\ 2 \times n \text{ matrix} \quad \text{EQN. 7}$$

where the first row of the compression matrix C has a value of 1 for every column corresponding to wavelengths less than 580 nm and a value of 0 for every column corresponding to wavelengths greater than or equal to 580 nm. The second row of the compression matrix C has a value of 0 for every column corresponding to wavelengths less than 580 nm and a value of 1 for every column corresponding to wavelengths greater than or equal to 580 nm. In embodiments where the wavelength intervals are not uniform, the entries having values of 1 are weighted based on the wavelength interval. As an illustrative example, a compression matrix C could have the following wavelength boundaries: 380 nm, 407 nm, 433 nm, 460 nm, 513 nm, 540 nm, 567 nm, 593 nm, 620 nm, 647 nm, 673 nm, 700 nm, 727 nm, 753 nm, and 780 nm. Spectrally compressed forms of the matrices R and T are determined as shown below in EQNS. 8 and 9, respectively:

$$\text{Spectrally Compressed Version of } R = C \otimes R \quad \text{EQN. 8}$$

$$\text{Spectrally Compressed Version of } T = C \otimes T \quad \text{EQN. 9}$$

The spectral compressions of the matrices R and T are written in EQNS. 8 and 9 as matrix multiplications. However, in some embodiments, due to the large number of 1's and 0's in the compression matrix C, summations can be used. For example, if the matrix $R=[r_{ij}]$, where i varies from 0 to p−1 and j varies from 0 to n−1, then C⊗R can be written as shown below in EQN. 10:

$$C \otimes R = \begin{bmatrix} \sum_{i=380nm}^{i<580nm} r_{i0}, & \sum_{i=380nm}^{i<580nm} r_{i1}, & \ldots, & \sum_{i=380nm}^{i<580nm} r_{i(n-1)} \\ \sum_{i=580nm}^{i\leq 780nm} r_{i0}, & \sum_{i=580nm}^{i\leq 780nm} r_{i1}, & \ldots, & \sum_{i=580nm}^{i\leq 780nm} r_{i(n-1)} \end{bmatrix} \quad \text{EQN. 10}$$

which is less computationally complex than a full matrix multiplication.

The controller 400 is also configured to determine or compute values related to the reference light fixture 435, as provided below in EQN. 11:

$$\vec{L} = \begin{bmatrix} l_0 \\ l_1 \\ \ldots \\ l_{(n-1)} \end{bmatrix} \quad \text{EQN. 11}$$

where $\vec{L}$ are dynamic levels for the reference light fixture 435. For example, the dynamic levels would normally be DMX levels converted to a range of [0.0→1.0]. Using the dynamic levels of the reference light fixture 435, the controller 400 is configured to compute a dynamic version of $\overrightarrow{XYZV}$ and a dynamic compressed spectrum for the reference light fixture 435, as shown below in EQNS. 12 and 13:

$$\overrightarrow{XYZV} = \begin{bmatrix} X \\ Y \\ Z \\ V \end{bmatrix} = XYZV^r \otimes \vec{L} \quad \text{EQN. 12}$$

$$\vec{r} = C \otimes R \otimes \vec{L} \quad \text{EQN. 13}$$

Using $\overrightarrow{XYZV}$, the controller 400 determines or calculates the dynamic color coordinate (x, y) for the reference light fixture, as shown below in EQNS. 14 and 15:

$$x = X/(X+Y+Z) \quad \text{EQN. 14}$$

$$y = Y/(X+Y+Z) \quad \text{EQN. 15}$$

The controller 400 is then configured to use a number of additional parameters to determine a resultant output vector $\vec{R}$ for the reference light fixture 435. The resultant output vector $\vec{R}$ for the reference light fixture 435 corresponds to a best spectral match between the reference light fixture 435's output and the light fixture 130-145's output. The additional parameters can include those shown below in EQNS. 16-25:

$$x \Leftarrow x * XYONE \quad \text{EQN. 16}$$

$$y \Leftarrow y * XYONE \quad \text{EQN. 17}$$

$$n\text{sources} \Leftarrow n \quad \text{EQN. 18}$$

$$n\text{points} \Leftarrow k \quad \text{EQN. 19}$$

$$\text{spectrums} \Leftarrow (C \otimes T) \| \vec{r} \quad \text{EQN. 20}$$

$$XYZ \Leftarrow XYZV^t \| \overrightarrow{XYZV} (n+1 \text{ columns}) \quad \text{EQN. 21}$$

$$\text{ledlevels} \Leftrightarrow [-1.0, -1.0, \ldots, -1.0] (n \text{ elements}) \quad \text{EQN. 22}$$

$$wx \Leftarrow -1 \quad \text{EQN. 23}$$

$$wy \Leftarrow -1 \quad \text{EQN. 24}$$

$$\text{brightnessMinimum} \Leftarrow 0 \quad \text{EQN. 25}$$

where XYONE is a compilation constant that sets the precision of an input color, n is the number of light fixture color channels, and k is the number of points in a compressed spectrum. In some embodiments, additional, fewer, or different parameters can be used to determine the resultant output vector $\vec{R}$ for the reference light fixture 435. EQNS. 16-25 are illustrative of a set of additional parameters that can be used in some embodiments.

The controller 400 returns Boolean values indicating whether the result is IN (0) or OUT (1) of the gamut of the light fixture 130-145. The n elements of the ledlevels array contains the levels [0.0→1.0] for the color channels of the light fixture 130-145. Those n elements form a solution vector $\vec{S}$ used to produce the resultant output vector $\vec{R}$ as shown below in EQN. 26:

$$\vec{R} = \left(\frac{\|\vec{L}\|_\infty}{\|\vec{S}\|_\infty}\right)\vec{S} \quad \text{EQN. 26}$$

which normalizes the result so the highest value in the result is the same as the highest value in dynamic values vector $\vec{L}$. The solution vector $\vec{S}$ can then be used to drive the color channels of the light fixture 130-145.

In some embodiments, the processing and memory requirements related to matching the light fixture 130-145's output to the reference light fixture 435's output can be further reduced. For example, to further reduce processing and memory requirements for the light fixture 130-145, the light fixture 130-145's color channels can be normalized to match color channel drive values for the reference light fixture 435. The color channels can then be controlled to maximize brightness and match the reference light fixture 435's output (e.g., color coordinate and/or spectrum) within a reduced variation window (e.g., approximately +/−5%) centered around the normalized color channel values. By restricting the color channel modifications that are made by the light fixture 130-145 to match the output of the of the reference light fixture 435, the light fixture 130-145 is capable of operating with fewer computational and memory resources.

For example, such a control technique uses the inputs described above with respect to EQNS. 1-3. The technique also implements a normalization vector $\vec{N}$ that is determined as shown below in EQNS. 27-29:

$$\overrightarrow{X+Y+Z}^r = [1,1,1,0] \otimes XYZV^r \quad \text{EQN. 27}$$

$$\overrightarrow{X+Y+Z}^t = [1,1,1,0] \otimes XYZV^t \quad \text{EQN. 28}$$

$$\vec{N} = \frac{\overrightarrow{X+Y+Z}^r}{\overrightarrow{X+Y+Z}^t} \quad \text{EQN. 29}$$

where $\vec{N}$ includes the element by element ratio of the X+Y+Z values of the LED light sources in the light fixture 130-145 and the reference light fixture 435. In some embodiments, the normalization vector $\vec{N}$ is calculated only once for the light fixture 130-145.

Input parameter, δ, represents an amount (e.g., having a value of 0.1 to 1.0) by which the light fixture 130-145 is allowed to vary with respect to the reference light fixture 435, as shown below in EQNS. 30 and 31:

$$\vec{L_n} = \left(\frac{\vec{N} * \vec{L}}{\|\vec{N} * \vec{L}\|}\right)_\infty \quad \text{EQN. 30}$$

$$\overrightarrow{LL} = \min\left(\max\left(\vec{L_n} - \frac{\vec{\delta}}{2}, \vec{0}\right), \overrightarrow{1.0} - \vec{\delta}\right) \quad \text{EQN. 31}$$

where the MAX and MIN are determined on an element by element basis. Each element of the vector $\overrightarrow{LL}$ is greater than or equal to zero and at least one element is equal to 1.0-δ. When every element in the vector $\vec{L}$ is zero, the resultant vector $\vec{R}$ has a value of zero and further calculations can be skipped. When at least one element in the vector $\vec{L}$ is not zero, a vector $\vec{B}$ can be calculated as shown below in EQN. 32:

$$\vec{B} = \left(\frac{1}{\delta} O \otimes T\right) \otimes \overrightarrow{LL} \quad \text{EQN. 32}$$

The vector $\vec{B}$ corresponds to a light fixture 130-145 where all the light sources are driven at their lower limits. The controller 400 is again configured to use a number of additional parameters to determine a resultant output vector $\vec{R}$ for the reference light fixture 435. The resultant output vector $\vec{R}$ for the reference light fixture 435 corresponds to a brightest way of the light fixture 130-145 to produce the desired output based on the amount by which the light fixture 130-145 is allowed to vary with respect to the reference light fixture 435. The additional parameters can include those shown below in EQNS. 33-42:

$$x \Leftarrow x * XYONE \quad \text{EQN. 33}$$

$$y \Leftarrow y * XYONE \quad \text{EQN. 34}$$

$$n\text{sources} \Leftarrow n+1 \quad \text{EQN. 35}$$

$$n\text{points} \Leftarrow 0 \quad \text{EQN. 36}$$

$$\text{spectrums} \Leftarrow 0(NIL) \quad \text{EQN. 37}$$

$$XYZ \Leftarrow XYZV^r \| \vec{B} \| \vec{0}\ (n+2 \text{ columns}) \quad \text{EQN. 38}$$

$$\text{ledlevels} \Leftrightarrow [-1.0, -1.0, \ldots, -1.0]\ (n+1 \text{ elements}) \quad \text{EQN. 39}$$

$$wx \Leftarrow -1 \quad \text{EQN. 40}$$

$$wy \Leftarrow -1 \quad \text{EQN. 41}$$

$$\text{brightnessMinimum} \Leftarrow 0 \quad \text{EQN. 42}$$

In some embodiments, additional, fewer, or different parameters can be used to determine the resultant output vector $\vec{R}$ for the reference light fixture 435. EQNS. 33-42 are illustrative of a set of additional parameters that can be used in some embodiments. In some embodiments, the resultant output vector $\vec{R}$ determined using EQNS. 33-42 is calculated approximately 8-10 times faster than the resultant output vector $\vec{R}$ determined using EQNS. 16-25.

The controller 400 is configured to return a resultant vector $\vec{R}$ having a length of n+1, where solution vector $\vec{S}$ is the first n elements of ledlevels, as shown below in EQN. 43:

$$\vec{R} = \left(\frac{\|\vec{L}\|_\infty}{\|\vec{S} + \vec{LL}\|_\infty}\right)(\vec{S} + \vec{LL}) \quad \text{EQN. 43}$$

The solution vector $\vec{S}$ can then be used to drive the color channels of the light fixture 130-145.

In some embodiments, the vector $\vec{N}$ from EQN. 29 is used together with the vector $\vec{L}$ from EQN. 11 to produce a resultant vector $\vec{R}$ as shown below in EQN. 44:

$$\vec{R} = \left(\frac{\|\vec{L}\|_\infty}{\|\vec{N} * \vec{L}\|_\infty}\right)\vec{N} * \vec{L} \quad \text{EQN. 44}$$

where the vector $\vec{N}$ includes the element by element ratio of the X+Y+Z values of the LED light sources in the light fixture 130-145 and the reference light fixture 435, and the vector $\vec{L}$ includes the dynamic levels for the reference light fixture 435. EQN. 44 enables the controller 400 to bypass additional computations (e.g., related to EQNS. 16-25 or EQNS. 33-42) to both more quickly and more efficiently generate the resultant vector $\vec{R}$. In some embodiments, the multiplication factors in EQN. 44 are constant for the reference light fixture 435 and the light fixture 130-145.

Figure 6:
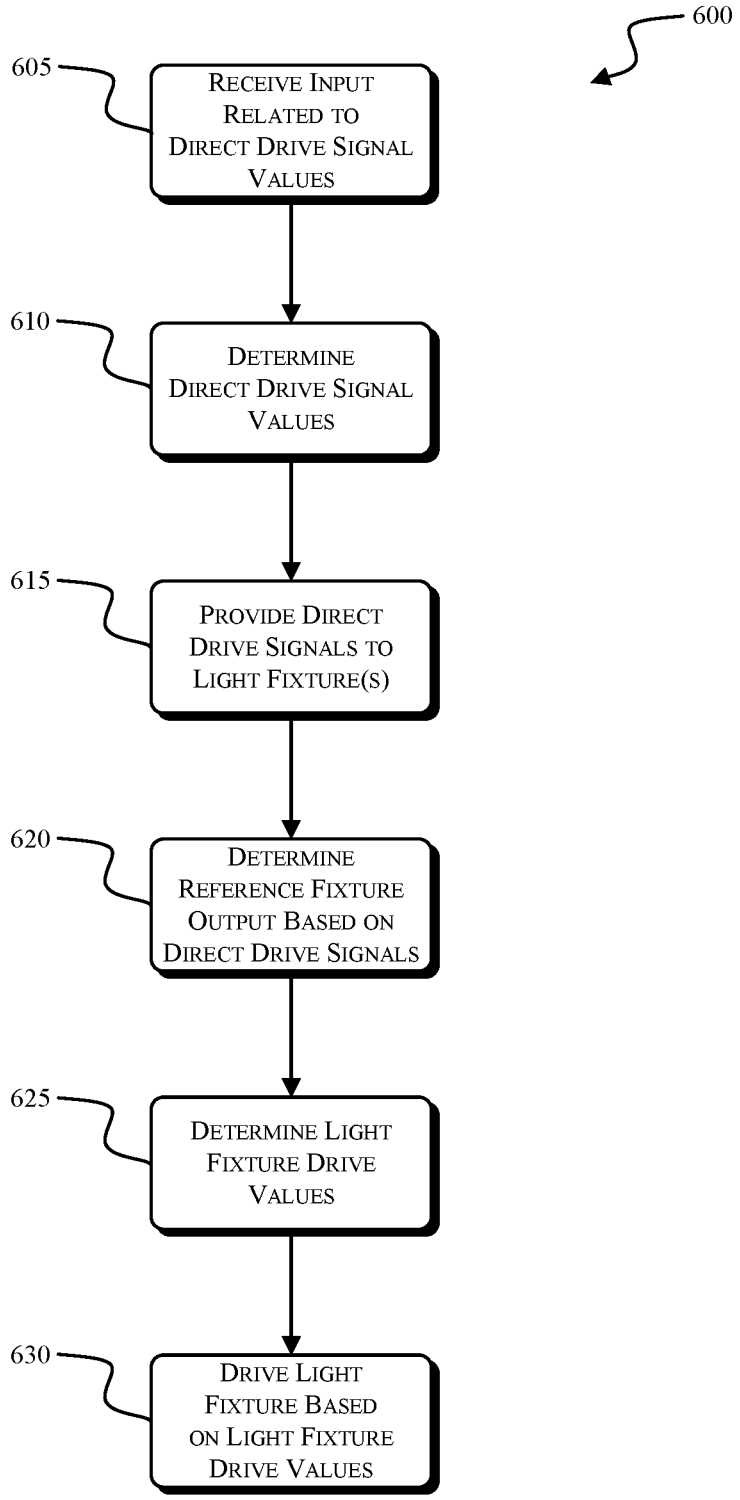
FIG. 6 is a process for controlling an output of a light fixture, according to embodiments described herein.

FIG. 6 illustrates a process 600 for controlling the output of the one or more light fixtures 130-145. The process 600 begins with receiving an input related to direct drive signal values (STEP 605). The input can be received, for example, from a user at one of the devices 105-120, and then provided to the control board 125. In some embodiments, the input related to the direct drive signal values is received directly at the control board 125. In other embodiments, the input related to the direct drive signal values is received at one of the devices 105-120 or the control board 125 from the remote server 160 over the network 155. The controller 200 or control board 125 then determines direct drive signal values to be provided to the light fixtures 130-145 based on the received input (STEP 610).

After determining the direct drive signal values at STEP 610, corresponding direct drive signals are generated and provided as inputs to the light fixtures 130-145 (STEP 615). After receiving the direct drive signals, the controller 400 associated with each of the light fixtures 130-145 determines the output corresponding to the reference light fixture 435 (STEP 620). In some embodiments, the output of the reference light fixture is determined using EQNS. 1-26. In other embodiments, the output of the reference light fixture is determined using EQNS. 1-5 and 27-43. As described above, the output of the reference light fixture can include both a reference output color and a reference output spectrum. Following STEP 620, the controller 400 determines the respective light fixture drive values for each of the light fixtures 130-145 that are required for the light fixture 130-145 to produce the output of the reference light fixture 435 (STEP 625). The respective light fixture drive values are determined by the controller 400 based on the calibration information or data related to the actual LED light sources in the light fixture 130-145. In some embodiments, the color and/or spectral matching of the output of the light fixture 130-145 can be performed by the controller 400 using a known color and/or spectral matching algorithm for an LED light fixture (e.g., an iterative color creation and matching algorithm operating in the CIE xy Y color space).

In some embodiments, the controller 400 is configured to exactly match the reference output color of the reference light fixture 435 and exactly match the reference output spectrum of the reference light fixture 435 (e.g., within an industry-accepted margin of error). In other embodiments, the controller 400 is configured to exactly match the reference output color of the reference light fixture 435 and approximately match the reference output spectrum of the reference light fixture 435 (e.g., produce a best spectral match to the reference output spectrum). In other embodiments, the controller 400 is configured to approximately match the reference output color of the reference light fixture 435 (e.g., produce a best color match to the reference output color) and approximately match the reference output spectrum of the reference light fixture 435 (e.g., produce a best spectral match to the reference output spectrum). After the drive values for the light fixture 130-145 have been determined at STEP 625), the controller 400 provides corresponding control signals to the driver circuits 405-415 to drive the arrays of light sources 420-430.

Thus, embodiments described herein provide, among other things, systems, methods, and devices for controlling the outputs of one or more light fixtures. Various features and advantages are set forth in the following claims.

What is claimed is:

1. A light fixture comprising:

an array of light-emitting diode ("LED") light sources corresponding to a color channel of the light fixture;

a driver circuit configured to drive the array of LED light sources; and a controller including a non-transitory computer readable medium and a processing unit, the controller including computer executable instructions stored in the computer readable medium for controlling operation of the light fixture to:

receive a direct drive signal related to a direct drive signal value for the array of LED light sources, determine an output of a reference light fixture based on the direct drive signal, determine a value for a color channel drive signal based on the output of the reference light fixture, the value for the color channel drive signal corresponding to a drive value for the color channel that results in an output of the light fixture that matches the output of the reference light fixture, and provide a control signal to the driver circuit to cause the driver circuit to apply the color channel drive signal having the value to the array of LED light sources.

2. The light fixture of claim 1, wherein the output of the reference light fixture includes a reference light fixture output color point.

3. The light fixture of claim 2, wherein the output of the reference light fixture includes a reference light fixture output color spectrum.

4. The light fixture of claim 3, wherein the output of the light fixture approximately matches the reference light fixture output color point and approximately matches the reference light fixture output color spectrum.

5. The light fixture of claim 1, further comprising:

a second array of LED light sources corresponding to a second color channel of the light fixture; and a second driver circuit configured to drive the second array of LED light sources.

6. The light fixture of claim 5, wherein the controller further includes computer executable instructions stored in the computer readable medium for controlling operation of the light fixture to:

determine a second value for a second color channel drive signal based on the output of the reference light fixture, the second value for the second color channel drive signal corresponding to a drive value for the second color channel that results in the output of the light fixture that matches the output of the reference light fixture; and provide a second control signal to the second driver circuit to cause the second driver circuit to apply the second color channel drive signal having the second value to the second array of LED light sources.

7. A system for controlling an output of each of a plurality of light fixtures, the system comprising:

a controller configured to generate a direct drive signal related to a direct drive signal value for one or more arrays of light-emitting diode ("LED") light sources; and a light fixture including an array of LED light sources corresponding to a color channel of the light fixture;

a driver circuit configured to drive the array of LED light sources; and a light fixture controller including a non-transitory computer readable medium and a processing unit, the light fixture controller including computer executable instructions stored in the computer readable medium for controlling operation of the light fixture to:

receive the direct drive signal related to the direct drive signal value for the one or more arrays of LED light sources, determine an output of a reference light fixture based on the direct drive signal, determine a value for a color channel drive signal based on the output of the reference light fixture, the value for the color channel drive signal corresponding to a drive value for the color channel that results in an output of the light fixture that matches the output of the reference light fixture, and provide a control signal to the driver circuit to cause the driver circuit to apply the color channel drive signal having the value to the array of LED light sources.

8. The system of claim 7, further comprising:

a second light fixture including a second array of LED light sources corresponding to a second color channel of the second light fixture;

a second driver circuit configured to drive the second array of LED light sources; and a second light fixture controller including a second non-transitory computer readable medium and a second processing unit, the second light fixture controller including computer executable instructions stored in the second computer readable medium for controlling operation of the second light fixture to:

receive the direct drive signal related to the direct drive signal value for the one or more arrays of LED light sources, determine the output of the reference light fixture based on the direct drive signal, determine a second value for a second color channel drive signal based on the output of the reference light fixture, the second value for the second color channel drive signal corresponding to a drive value for the second color channel that results in an output of the second light fixture that matches the output of the reference light fixture, and provide a second control signal to the second driver circuit to cause the second driver circuit to apply the second color channel drive signal having the second value to the second array of LED light sources.

9. The system of claim 8, wherein the value for the color channel drive signal is different than the second value for the second color channel drive signal.

10. The system of claim 7, wherein the output of the reference light fixture includes a reference light fixture output color point.

11. The system of claim 10, wherein the output of the reference light fixture includes a reference light fixture output color spectrum.

12. The system of claim 11, wherein the output of the light fixture approximately matches the reference light fixture output color point and approximately matches the reference light fixture output color spectrum.

13. The system of claim 7, wherein the controller is configured to receive an input from a user input device and generate the direct drive signal based on the input from the user input device.

14. A method of controlling a light fixture, the method comprising:

receiving a direct drive signal related to a direct drive signal value for an array of light-emitting diode ("LED") light sources;

determining an output of a reference light fixture based on the direct drive signal;

determining a value for a color channel drive signal based on the output of the reference light fixture, the value for the color channel drive signal corresponding to a drive value for a color channel that results in an output of the light fixture that matches the output of the reference light fixture; and providing the color channel drive signal having the value to the array of LED light sources.

15. The method of claim 14, wherein the output of the reference light fixture includes a reference light fixture output color point.

16. The method of claim 15, wherein the output of the reference light fixture includes a reference light fixture output color spectrum.

17. The method of claim 16, wherein the output of the light fixture approximately matches the reference light fixture output color point and approximately matches the reference light fixture output color spectrum.

18. The method of claim 14, further comprising determining a second value for a second color channel drive signal based on the output of the reference light fixture, the second value for the second color channel drive signal corresponding to a drive value for a second color channel that results in the output of the light fixture that matches the output of the reference light fixture; and providing the second color channel drive signal having the second value to a second array of LED light sources.

19. The method of claim 18, wherein the value for the color channel drive signal and the second value for the second color channel drive signal are different than the direct drive signal value for the direct drive signal.

20. The method of claim 14, further comprising receiving an input from a user input device; and generating the direct drive signal based on the input from the user input device.

* * * * *